US005673690A

United States Patent [19]

Tayebi et al.

[11] Patent Number: 5,673,690

[45] Date of Patent: Oct. 7, 1997

[54] BREATHING MASK

[75] Inventors: Amad Tayebi, Westford; Ashish K. Mithal, Lowell; Tanya A. Kyslowsky, Andover; George S. Saati, Billerica, all of Mass.; Scott W. Cormier, Windham, N.H.

[73] Assignee: Better Breathing, Inc., Lawrence, Mass.

[21] Appl. No.: 623,853

[22] Filed: Mar. 26, 1996

[51] Int. Cl.[6] ..... A62B 7/10

[52] U.S. Cl. ..... 128/206.24; 128/205.27; 128/205.29; 128/206.19; 128/206.23

[58] Field of Search ..... 128/205.27, 205.29, 128/206.19, 206.23, 206.24, 201.15, 206.16, 206.17

[56] References Cited

U.S. PATENT DOCUMENTS

| | | | |
|---|---|---|---|
| 4,971,051 | 11/1990 | Toffolon | 128/206.26 |
| 5,181,506 | 1/1993 | Tardiff et al. | 128/206.24 |
| 5,419,318 | 5/1995 | Tayebi | 128/205.27 |
| 5,520,167 | 5/1996 | Hamilton | 128/206.21 |

FOREIGN PATENT DOCUMENTS

| | | | |
|---|---|---|---|
| 02726 | 8/1983 | Germany | 128/205.29 |

*Primary Examiner*—Vincent Millin
*Assistant Examiner*—William J. Deane, Jr.

[57] ABSTRACT

The present invention provides different size breathing masks in which single size filtration shells are attached to single size face contacting members at the same periphery. A single size face contacting member has one, or more than one size, inner breathing opening with a narrower cut profile in the nose area than in the mouth and chin area. Such different size breathing masks would fit and provide effective seal for more than one wearer's size.

1 Claim, 6 Drawing Sheets

BREATHING MASK

FIELD OF THE INVENTION

The present invention relates to breathing masks used for wearer protection from contaminants in hazardous environments. In particular, it provides a low cost size-determining face piece liner for masks. The face piece liner of the present invention makes it possible to combine single size filtration shells with a variety of soft, flexible face piece liners having distinctly different shape breathing openings in order to obtain face masks that fit and provide an effective seal for more than one wearer's face size.

BACKGROUND OF THE INVENTION

A relevant detailed background of respirators and respirator face pieces of the prior art is given, by a co-author of the present invention, in U.S. Pat. Nos. 4,856,508 and 5,419,318.

In U.S. Pat. No. 5,419,318 a breathing mask is disclosed which features a soft, flexible face contacting member and and outer filtration shell member fastened thereto to form a mask. The face contacting member is three-dimensionally formed in an arctuate shade that provides a cup in which the chin of the mask wearer rests in order to prevent the mask from slipping under the chin of the wearer. The outer shell member is either an air permeable filtration material or may be a rigid air impervious material through which air filtration element(s) are mounted to filter breathed air. As practiced by Better Breathing, Inc. and as shown in FIG. (1), the teachings of U.S. Pat. No. 5,419,318 make it possible to manufacture face masks that fit and provide an effective seal for more than one wearer's size by combining single size filtration shells with more than one size soft, flexible face contacting members, formed in more than one size arctuate shapes, featuring more than one size chin cups, having more than one size inner breathing openings and fastened to the single size filtration at the same outer periphery. As shown in FIG. (1), face mask 100, place on small size wearer's face 101-*a* (shown in solid line), combines filtration shell 102 with small size face contacting member 103-*a*, formed in small size arctuate shape 104-*a* and having small size chin cup 105-*a* and small size inner breathing opening 106-*a*. Small size face contacting member 103-*a* and filtration shell 102 are fastened to each other at outer periphery (107). Also, as shown in FIG. (1), face mask 100, placed on large size wearer's face 101-*b* (shown in dashed line) combines same size filtration shell 102 with large size face contacting member 103-*b*, formed in large size arctuate shape 104-*b* and having large size chin cup 105-*b* and large size inner Breathing opening 106-*b*. Large size face contacting member 103-*b* and same size filtration shell 102 are fastened to each other at same outer periphery 107.

Another relevant prior art mask, manufactured by Minnesota Mining and Manufacturing Company, St. Paul. Minn., (Style No. 9970), features as shown in FIG. (2), a single size filtration shell (202) attached to soft flexible planar face contacting member 203. In various sizes of face mask 200, planar face contacting member 203 appears to have approximately same size inner breathing opening 206 and appears to be fastened to filtration shell 202 at approximately same outer periphery 207. It is important and relevant to the present invention to also point out that inner breathing opening 206 is of an elliptical shape and is symmetric around axes X—X and Y—Y. As such, in order to conform face contacting member 203 to shape of wearer's face, a deformable strip (nose clip) (208) is attached onto filtration shell 202. Deformable strip (208) is shaped by the wearer to fit around his/her nose bridge in order to provide a seal. Mask 200 also features exhalation valve 209 and head band length adjustment brackets 210.

A third relevant prior art mask, manufactured Racal Health and Safety, Inc, Frederick, Md., Style No. Delta 3. features, as shown in FIG. (3), a filtration shell 302 attached to soft flexible face contacting member 303. In various sizes of mask 300, various sizes of filtration shell 302 are attached to various sizes of soft flexible face contacting member 303, having more than one size inner breathing opening 306, at distinctly different size outer peripheries 307. Again, it is important and relevant to the present invention to point out that inner breathing opening 306 is of a race track shape and is symmetric around axes X—X and Y—Y. As such and likewise, in order to conform face contacting member 303 to shape of wearer's face, a deformable nose clip 308 is attached to filtration shell 302 and shaped as described above. Mask 300 also features an exhalation valve 309.

Examination of prior art masks reveals a number of limitations, disadvantages and/or design inconsistencies, including; (1) producing a specific shape/size arctuate shape face contacting member for each wearer's size is costly, (2) producing a specific size filtration shell and a specific size face contacting member for each wearer's size is not only costly but also results in a higher breathing resistance and lower filtration efficiency in small size masks due to the smaller filtration area in small size masks, (3) attaching a single size filtration shell to face contacting members, having approximately the same size inner breathing opening, at approximately the same outer periphery yields masks of nominally different sizes but actually poor fit characteristics. Such poor fit was the subject of a report published by Dr. Nelson Leidel, formerly associated with the National Institute for Occupational Safety and Health (NIOSH), in 1994 and (4) using an inner breathing opening with symmetry about axis X—X (as shown in FIGS. 2 and 3) is inconsistent with how the facial nose area is inherently smaller and of narrower width than the mouth and chin area.

The present invention overcomes the limitations, disadvantages and design inconsistencies of the prior art by providing different size face masks in which a single size filtration shell is attached to a single size face contacting member at the same periphery, wherein the single size face contacting member has one, of more than one size, inner breathing opening with a narrower cut profile in the nose area than in the mouth and chin area. Such different size face masks would fit and provide effective seal for more than one wearer's size. A face mask that provides above features would not only eliminate all of the above-mentioned limitations, disadvantages and design inconsistencies but also have significant cost and manufacturing inventory control advantages.

The present invention also provides a face mask which, in addition to eliminating slippage relative to the wearer's face by deforming the flexible face liner to form a chin cup and providing an effective seal to the wearer's face, has no contact between the wearer's face and the filtration shell thereby ensuring a maximum area for flow of filtered air and, therefore, a minimum breathing resistance regardless of the wearer's face size.

DESCRIPTION OF THE DRAWING

The present invention will be better understood upon reading the following detailed description in conjunction with the drawing in which:

FIG. 4-A is a side view of breathing mask shown in FIG. 4.

FIG. 4-B is a side view of the mask of the present invention as mounted on wearer's face.

DETAILED DESCRIPTION

In accordance with the present invention, a size-determining face piece liner is a flexible face contacting member that has an inner breathing opening which is shaped to provide an aperture that has a narrow upper section and a wide lower section in order to surround and accommodate the nose and mouth of the wearer. The wearer's nose bridge and sides fit through and are surrounded by the upper section. The wearer's mouth fits through and is surrounded by the lower section.

Figure 1:
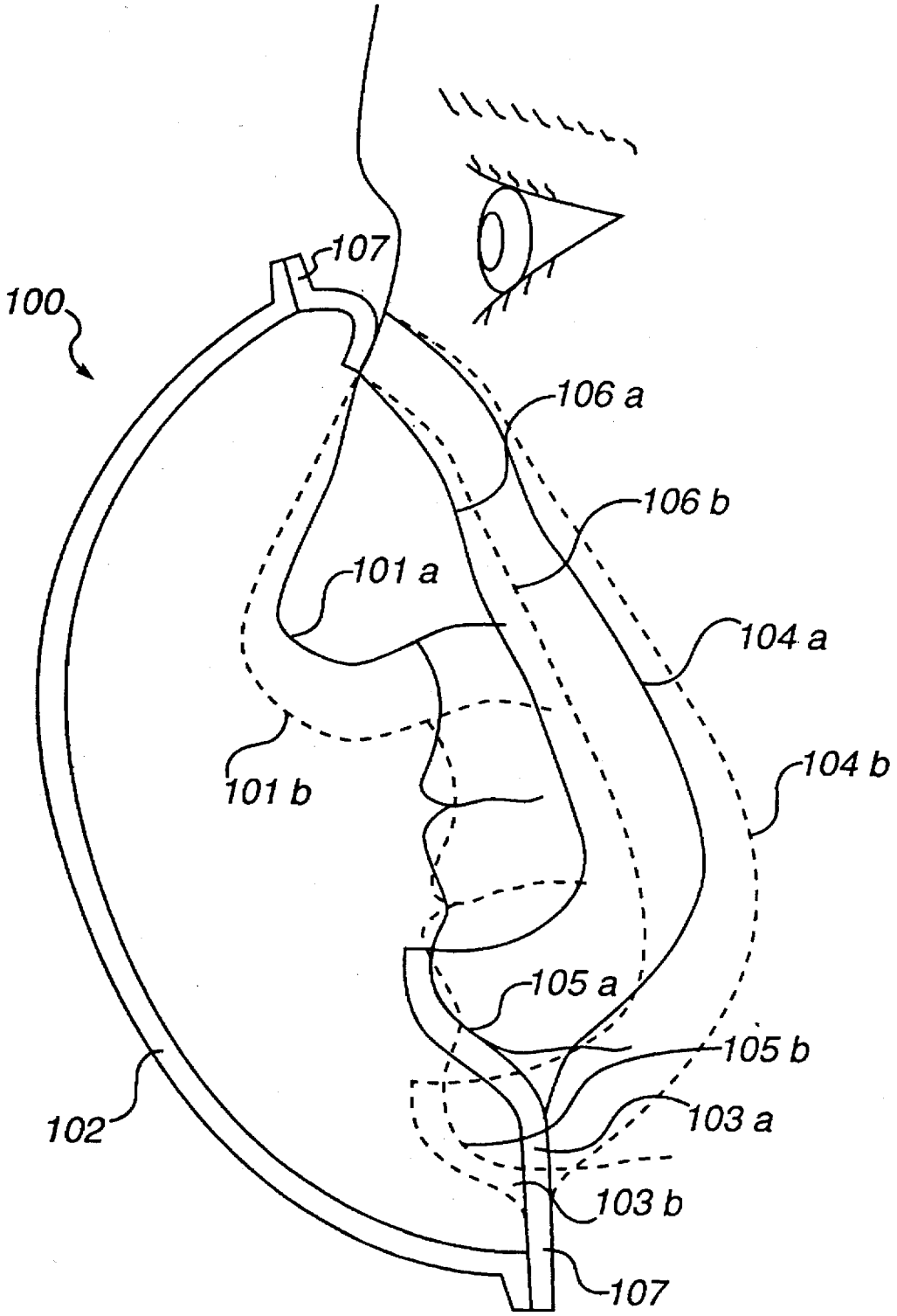
Figure 1 (Prior Art)
FIG. 1 is a side view of a prior art breathing mask.
Figure 2:
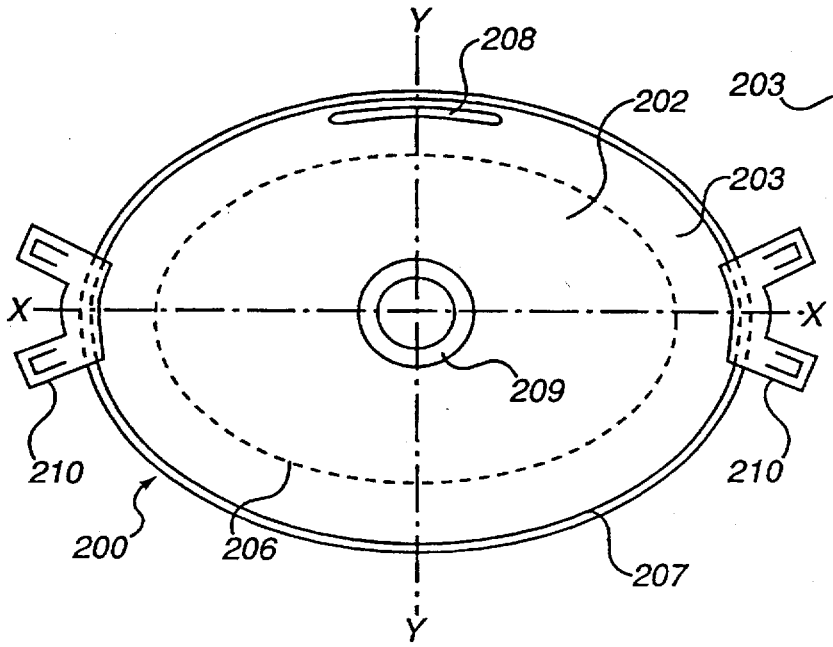
Figure 2 (Prior Art)
FIG. 2 is a front and side views of a prior art breathing mask.
Figure 2A:
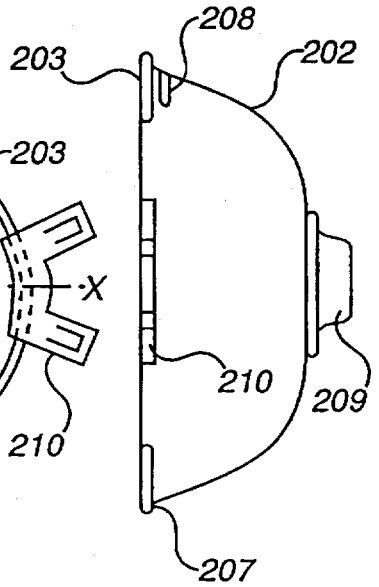
Figure 2 A (Prior Art)
Figure 3:
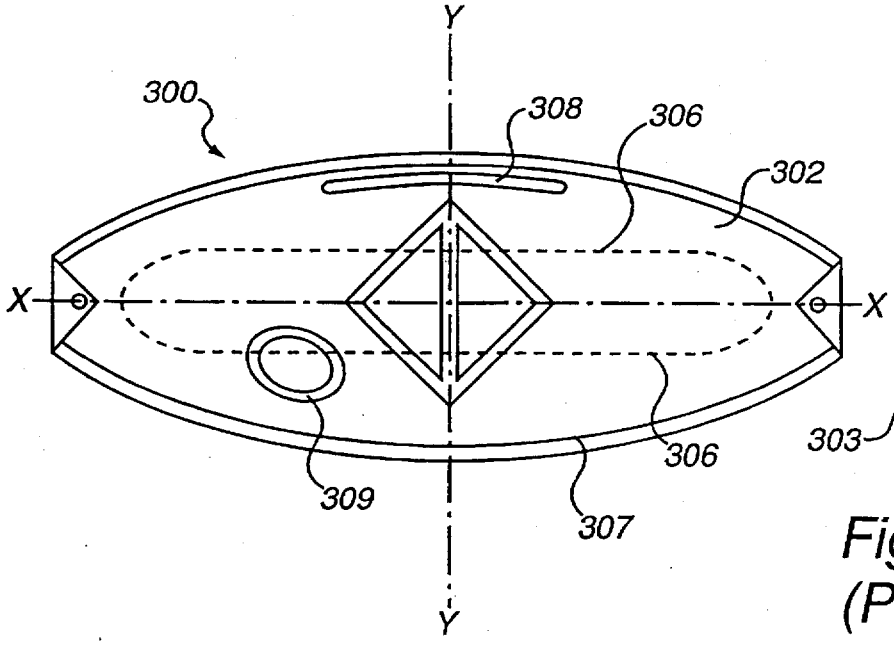
Figure 3 (Prior Art)
FIG. 3 is a front and side views of a prior art breathing mask.
Figure 3A:
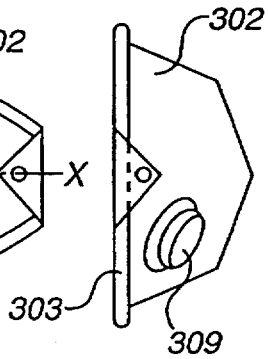
Figure 3 A (Prior Art)
Figure 4:
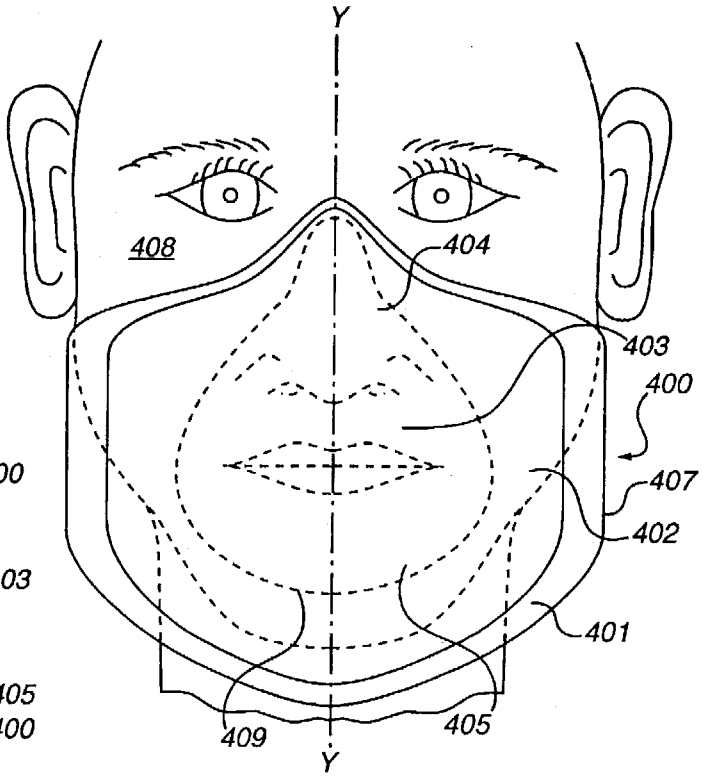
FIG. 4 is a front view of a Breathing mask in accordance with the present invention.
Figure 4A:
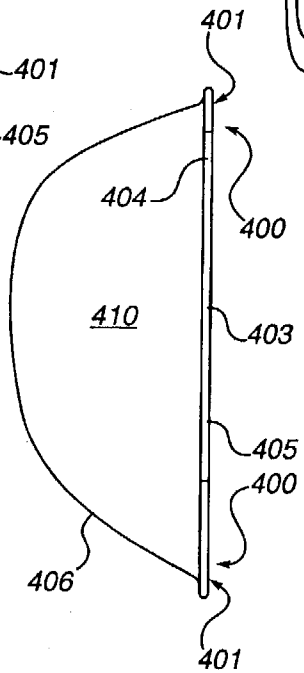
Figure 4B:
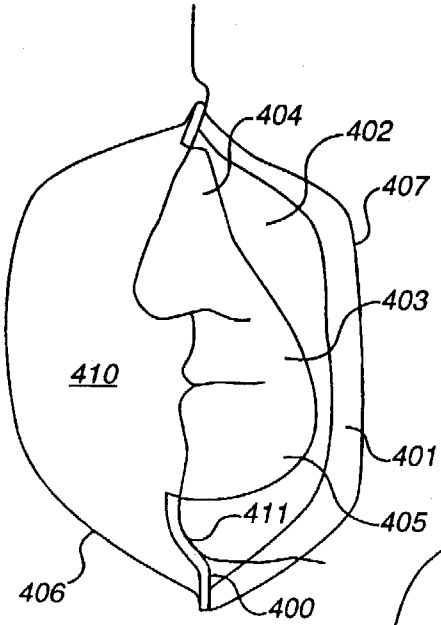

As shown in FIG. 4, in its simplest form, the face contacting member 400 is made of flexible sheet material and has an outer edge profile 407, a periphery zone 401 surrounded by outer edge profile 407, a face contacting zone 402 surrounded by periphery zone 401 and an inner breathing cut-out opening 403 located within face contacting zone 402. Opening 403 has a narrow upper section 404 and a wide lower section 405. Face contacting member 400 is placed on wearer's face 408 such that the inner edge profile 409 of inner breathing cut-out opening 403 surrounds the wearer's nose and mouth and provides an effective seal between face contacting zone 402 and wearer's face 408.

A side view of face mask 410, assembled by attaching face contacting member 400 to filtration shell 406 at periphery zone 401 is shown in FIG. 4-A. FIG. 4-B shows face mask 410 when placed on wearer's face. As shown therein, face contacting member 400 deforms in order to conform to and accommodate the wearer's nose and provide a chin cup 411 that conforms to and accommodates the wearer's chin and thereby provide an effective air tight seal between face contacting zone 402 and wearer's face.

In accordance with the present invention, filtration shell 406 may be made in a variety of shades known in the art, for example, it may be of a three dimensional-double curvature shape or of a folded or pleated shape. The folded surfaces and the pleats may be of a horizontal, vertical or any other orientation. Likewise, face contacting liner 400 may be of a substantially flat, or of a folded shape in order to conform to the shape of filtration shell 406.

Figure 5:
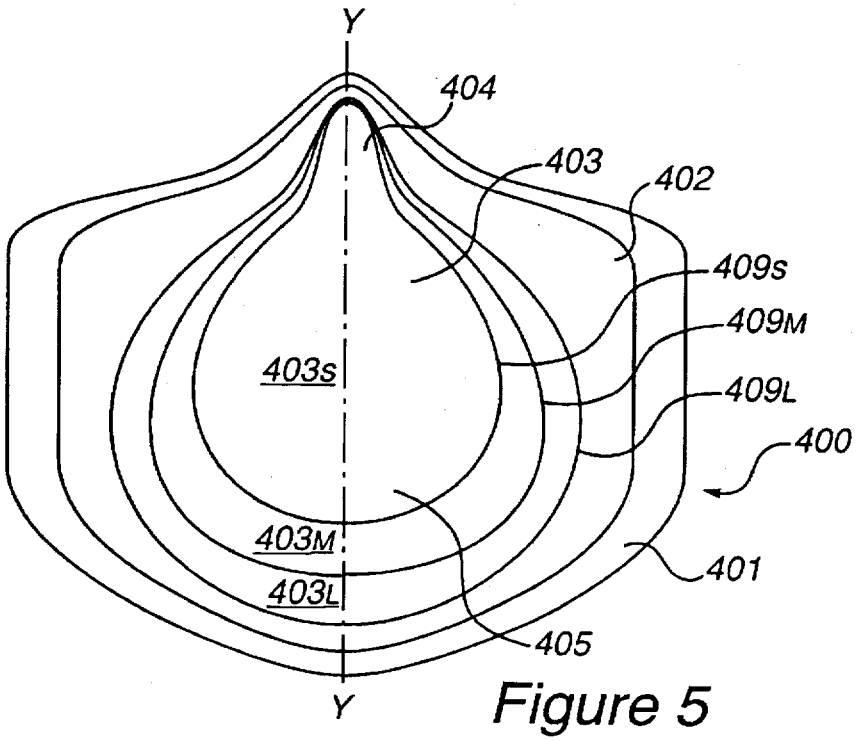
FIG. 5 is a front view of size-determining face piece liner of the present invention.
Figure 6:
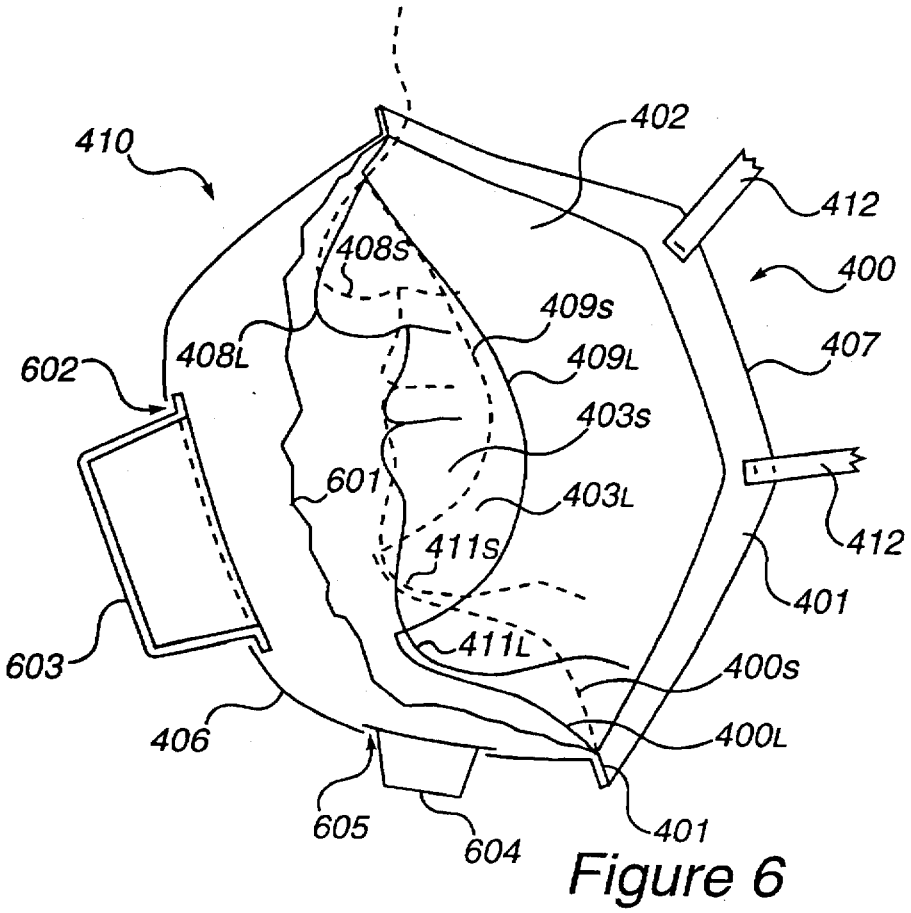
FIG. 6 shows a side cut-out superposed view of a small size mask as worn onto a small size wearer's face and a large size mask as worn onto a large size wearer's face in accordance with the present invention.

FIG. 5 shows a front view of the size-determining face piece liner of the present invention wherein a single size face contacting member 400 has inner breathing opening 403-S, 403-M, 403-L or any other size opening in order to make it possible to obtain face masks, that fit and provide an effective seal for small, medium, large or any other wearer's face size, respectively, by attaching filtration shell 406 to face contacting member 400 at periphery zone 401. As shown therein, cut-out openings 403-S, 403-M and 403-L are defined by inner edge profiles 409-S, 409-M and 409-L respectively.

FIG. (6) shows a side cut-out superposed view of a small size breathing mask 410 comprised of filtration shall 406 attached to face contacting member 400, having a small size inner breathing cut-out opening 403-S defined by profile 409-S (shown in dashed line), at periphery zone 401 as worn onto small size wearer's face 408-S (shown in dashed line) and a large size breathing mask 410 comprised of same shell 406 attached to another face contacting member 400, having a large size inner breathing cut-out opening 403-L defined by profile 409-L (shown in solid line), at same periphery zone 401 as worn onto large size wearer's face 408-L (shown in solid line). As shown therein, flexible face contacting members 400-S and 400-L deflect, deform and form small and large size chin cups in order to conform to and accommodate the nose and chin of small and large face contours 408-S and 408-L, respectively, and thereby provide an effective air tight seal between face contacting zone 402 and more than one size wearer's face. Cut-out line 601 and filtration shell 406 are common to small and large size masks and wearer's faces.

Filtration mask 410 may be securely mounted on the wearer's face by at least one headband 412 or by some other means known in the art. Formation of chin cup 411 also provides an effective seal with very low headband tension by providing a pivot point as taught in U.S. Pat. No. 5.419,318.

Filtration shell 406 may be made of a filtration air permeable material with a certain or desired filtration efficiency. In this respect, a variety of materials known in the art, or any combinations or multi-layer laminates thereof, may be used. Alternatively filtration shell 406 may be made of an air impervious material with at least one breathing opening 602 to which a filter element 603 is attached in order to filter all breathed air passing through Breathing opening 602.

A one-way exhalation valve, 604 may be installed in another opening 605 in filtration shell 406, preferably near the bottom of shell 406, to exhaust exhaled air, in a manner and construction known in the art. Filter element 603 and exhalation valve 604 are well known in the art and, therefore, are not described in further detail in this specification.

Face contacting member 400, which, in its simplest form, is generally planar, may be embossed, thermoformed, indented or shaped in the area around the nose, the wearer's cheeks and/or the chin in order to provide a more effective seal between its face contacting zone and the wearer's face.

In order to minimize the breathing resistance and maximize the filtration efficiency of mask 410, it is desirable to have face contacting zone 402 remain spaced apart from filtration shell 406, as shown in FIGS. (4-B) and (6).

Face contacting member 400 may be made of soft flexible air-impermeable material, material combinations or multi-layer laminates, including elastomeric and closed cell foam materials, or alternatively from air permeable materials, preferably with filtration efficiency and characteristics consistent with the filtration efficiency and characteristics of filtration shell 406.

In accordance with the present invention, inner breathing cut-out opening may be of a variety of shapes. Its inner edge profile may also be of an explicit or of an implicit nature without departing from the scope and spirit of the present invention. Regardless of its shape and the nature of its inner edge profile, the function performed by the inner breathing cut-out opening is always the same, namely providing an aperture that surrounds the nose and mouth of a wearer's face and thereby provide an effective air tight seal between face contacting zone 402 and wearer's face 408.

Figure 7:
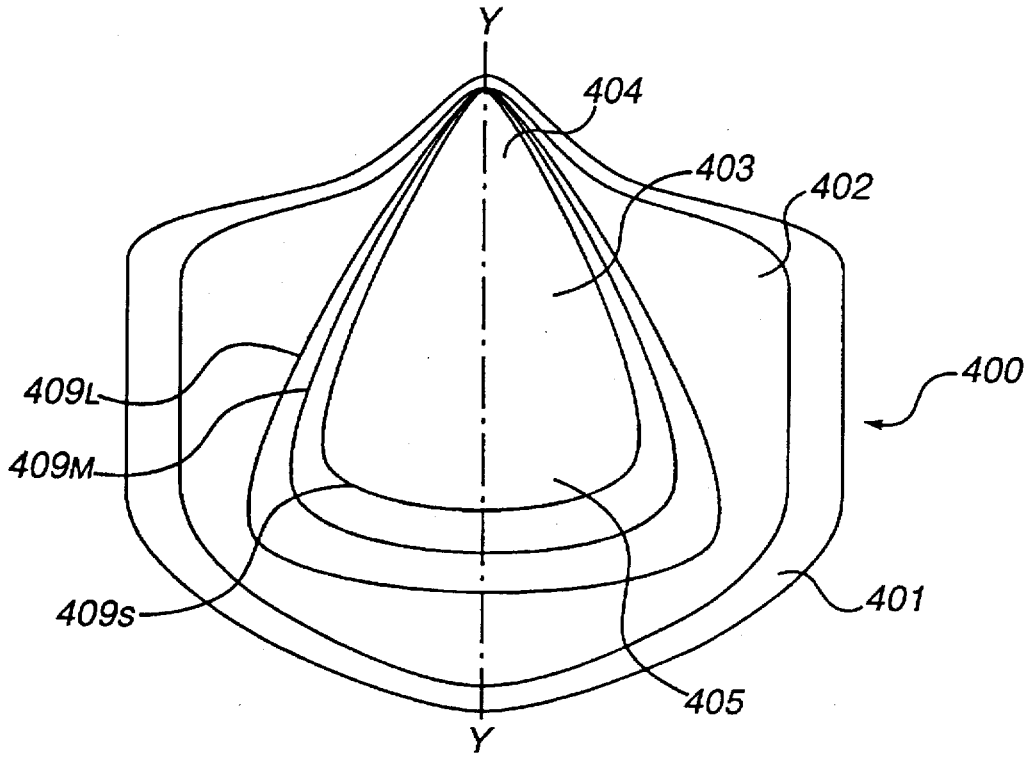
FIG. 7 is a front view of an alternative size-determining face piece liner in accordance with the present invention.
Figure 8:
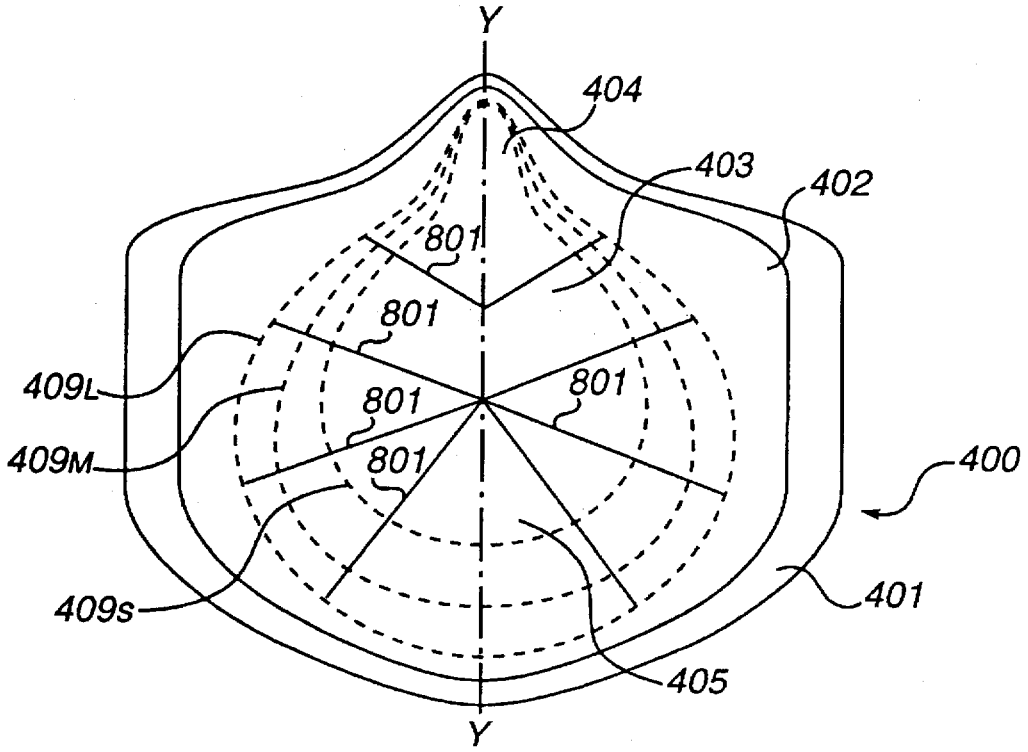
FIG. 8 is a front view of another alternative size-determining face piece liner in accordance with the present invention.
Figure 9:
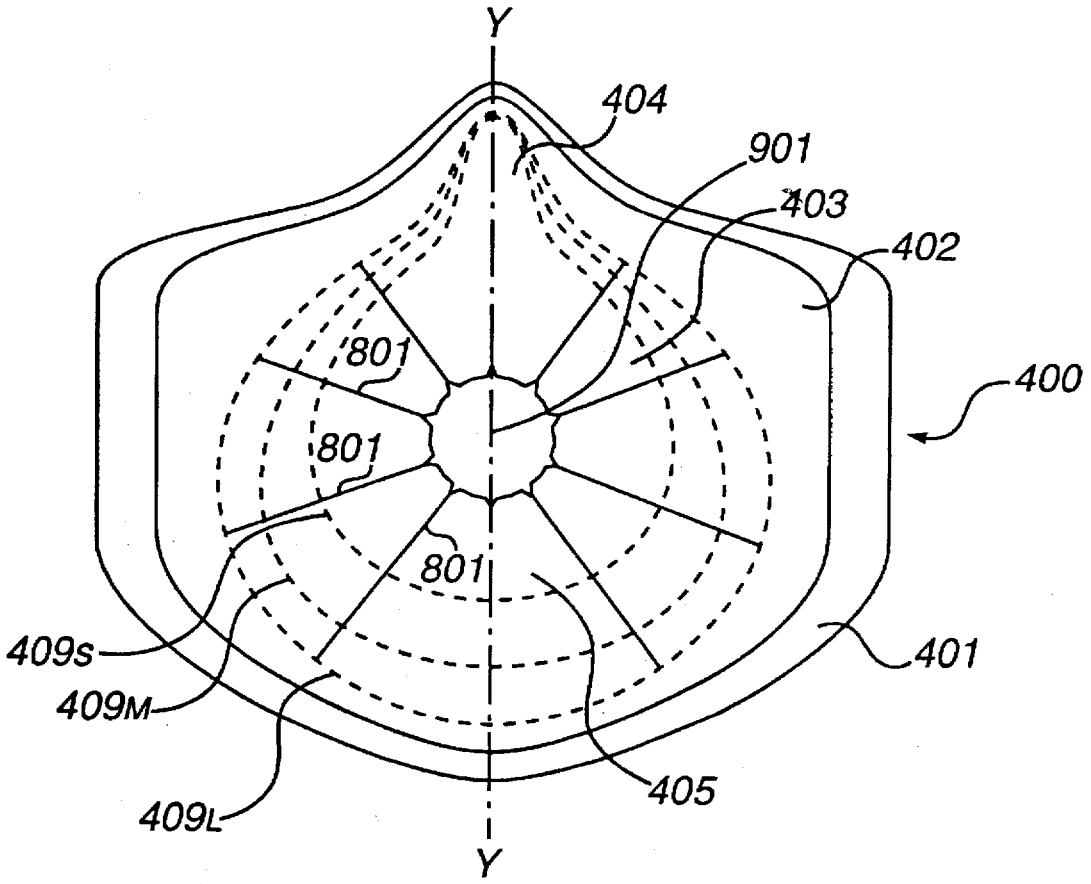
FIG. 9 is a front view of another alternative size-determining face piece liner in accordance with the present invention.

Examples of an explicit inner edge profile 409 are shown in FIGS. 4 and 5. An additional example of explicit inner edge profile 409 is shown in FIG. 7. An example of implicit nature inner edge profile 409 is shown in FIG. 8. As shown therein, depending on wearer's face size, slitting lines 801, which originate from the central zone of face contacting member 400, extend substantially radially up to imaginary inner edge profile lines 409-S, 409-M and 409-L for small, medium and large wearer's face sizes. Slitting lines 801 create wedge-shape segments which, when pushed by wearer's face, deflect away into the inner space of filtration shell 406 and provide an implicit inner edge profile of the desired size. Combinations of cut-cut holes and straight as well as curved slit lines may be utilized to make inner breathing cut-out openings of various sizes as shown in FIG. 9. As shown therein, a circular hole 901 is the origin zone of slitting lines 801 which, depending on wearer's face size, extend radially to imaginary or printed/embossed inner edge profile lines 409-S, 409-M or 409-L.

Alternatively, inner breathing cut-out opening may be custom tailored and cut by the wearer to fit his/her own facial configuration. Printed or embossed lines on blank or small size inner breathing cut-out opening face contacting zone 402 may not only be used for guiding the wearer in custom tailoring the face contacting member to his/her exact facial configuration and size but also in converting the size of inner breathing cut-out opening to a larger size. These features, which are not available in the prior art, are additional advantages of the present invention which also make it possible for the end user to carry few or even only one size mask in inventory and meet all size requirements, by custom tailoring the size of inner breathing cut-out opening to fit the particular wearer's face size. To help a wearer accomplish this, a variety of inner edge profile lines, for example 409-S, 409-M, 409-L may be imprinted or heavily embossed to act as tear-away impression lines that direct a tear line, started by the end user, to follow a selected size inner breathing cut-out opening.

While what has been described hereinabove is a variety of embodiments of the invention, it will be obvious to those skilled in the art that numerous changes may be made without departing from the scope and spirit of the invention.

What is claimed is:

1. A one-size-fits-all breathing mask for filtering air breathed by a wearer using the mask, said breathing mask comprising: a face contacting liner, said face contacting liner being made of flexible material and having a periphery zone and a generally planar face contacting zone, said face contacting zone being surrounded by said periphery zone and having an inner adjustable breathing opening, said inner breathing opening being symmetric around a vertical axis and comprising an upper section and a lower section, said upper section being smaller than said lower section, said adjustable inner breathing opening providing an effective seal between said face contacting zone and face of said wearer, said face contacting liner being attached to a filtration shell through which breathed air passes, said filtration shell having a periphery zone, said periphery zone of said face contacting liner being attached to said periphery zone of said filtration shell such that said filtration shell substantially completely covers said face contacting liner.

* * * * *